US007506871B2

(12) United States Patent
Giegerich

(10) Patent No.: US 7,506,871 B2
(45) Date of Patent: Mar. 24, 2009

(54) TABLE GAME HAVING AN ELEVATED PLATFORM

(75) Inventor: Paul Giegerich, Maple Glen, PA (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 11/457,516

(22) Filed: Jul. 14, 2006

(65) Prior Publication Data

US 2006/0244210 A1 Nov. 2, 2006

Related U.S. Application Data

(63) Continuation of application No. 10/756,523, filed on Jan. 13, 2004, now Pat. No. 7,108,262.

(60) Provisional application No. 60/440,705, filed on Jan. 16, 2003.

(51) Int. Cl.
*A63F 7/00* (2006.01)
*A63F 7/07* (2006.01)
*A63F 7/20* (2006.01)

(52) U.S. Cl. ..... 273/108; 273/108.5; 273/108.56; 273/129 R; 273/129 L; 273/148 R; 273/309

(58) Field of Classification Search ..... 272/129 R; 273/129 L, 148 R, 309, 148 B, 108, 108.5, 273/108.56, 129 R; 463/46, 47, 36, 37; 473/15, 473/116, 4, 10; 108/99, 134, 143, 50.14; 312/235.1–235.2; 291/423.28; 297/423.1, 297/423.19, 423.2, 423.22, 423.26, 423.27; 182/77, 88, 91, 129
See application file for complete search history.

(56) References Cited

U.S. PATENT DOCUMENTS

| | | | | | |
|---|---|---|---|---|---|
| 192,230 | A | * | 6/1877 | Chelini | 108/93 |
| 614,722 | A | * | 11/1898 | Isaacs | 312/227 |
| 1,933,210 | A | * | 10/1933 | Curtis | 108/50.14 |
| 1,971,295 | A | * | 8/1934 | Calaluca | 473/14 |
| 2,548,098 | A | * | 4/1951 | Clarin | 297/30 |
| 3,026,144 | A | * | 3/1962 | Clarin | 297/423.15 |
| 3,030,166 | A | * | 4/1962 | Baker et al. | 312/235.1 |
| 3,228,688 | A | | 1/1966 | Dennison | |
| 3,672,312 | A | * | 6/1972 | Pettit et al. | 108/69 |
| 3,858,877 | A | | 1/1975 | Lundstrom | |
| 4,135,604 | A | * | 1/1979 | Ryan | 182/91 |
| 4,185,832 | A | | 1/1980 | Traficante | |
| 4,278,252 | A | | 7/1981 | Lyons | |
| 4,516,774 | A | * | 5/1985 | Nankivell | 473/518 |
| 4,560,163 | A | | 12/1985 | Erickson | |
| 4,846,304 | A | * | 7/1989 | Rasmussen | 182/88 |
| 5,005,667 | A | * | 4/1991 | Anderson | 182/15 |
| 5,015,119 | A | | 5/1991 | Schmanski | |
| 5,085,290 | A | * | 2/1992 | Guirlinger | 182/77 |

(Continued)

*Primary Examiner*—Sebastiano Passaniti
(74) *Attorney, Agent, or Firm*—Panitch Schwarze Belisario & Nadel LLP

(57) ABSTRACT

A combination of an elevated platform and a game table having a support structure including a game table and an elevated platform. The elevated platform including at least one support arm releasably connectable to the support structure in a play position and further connectable to the support structure in a storage position. The elevated platform may be coupled to the game table for translation relative to the support structure between the play and storage positions. The elevated platform may also be hingedly coupled to the supporting structure.

7 Claims, 10 Drawing Sheets

U.S. PATENT DOCUMENTS 5,094,515 A * 3/1992 Low ..... 312/235.1
5,242,164 A * 9/1993 Nicoll ..... 273/317.1
5,341,897 A * 8/1994 Gross ..... 182/88
5,366,427 A * 11/1994 Price, II ..... 482/92
6,063,005 A 5/2000 Schwartz
6,669,602 B1 * 12/2003 Tsai ..... 482/54
2001/0033054 A1 * 10/2001 Rossi et al. ..... 273/126 R

* cited by examiner

TABLE GAME HAVING AN ELEVATED PLATFORM

CROSS-REFERENCE TO RELATED APPLICATIONS

This application is a division of U.S. patent application Ser. No. 10/756,523, filed Jan. 13, 2004 and claims the benefit of U.S. Provisional Patent Application 60/440,705, filed Jan. 16, 2003.

BACKGROUND OF THE INVENTION

The present invention relates generally to table games and, more particularly, to accessories to be used with table hockey and other table games.

Table games are well known in the art and are commercially available from a variety of sources. In the game of table hockey, each player is provided with a paddle to use to strike a puck. Typically, players grasp the paddle bare-handed. It is possible therefore for the puck to strike a player's bare hand if, for example, the puck should become airborne, leaving the surface of the table, or if a player's finger should be dangled between the paddle and the puck. Further, the paddle is typically not attached to the hand or wrist of the player, thus creating the potential for a paddle to slip from a player's hand, creating a projectile hazard. A need exists, therefore for a device which would serve to protect the hands of players engaged in table hockey. A further need exists for a device which would reduce the potential of a table hockey paddle inadvertently slipping from a player's grasp while engaged in play.

In table games such as table hockey, the players typically have a clear view of the entire game table surface during play. In the game of table hockey, much of the challenge, and therefore pleasure, of the game derives from the speed of the game, and the need for quick responses from the player. For a given table size and puck speed, having a clear view of the entire game table surface increases the amount of time a player has to react to an opponent's play. A need exists for a device which would increase the challenge of the game by requiring faster responses on the part of the players by decreasing each player's view of the table surface.

Table games typically provide a table surface at a fixed height above the supporting floor or ground surface. The height of the table surface is generally chosen to be at a level comfortable for adult players of average size. Accommodating the comfort of players of significantly different heights (such as an adult and a child) is difficult. A need exists, therefore, for a device which allows players of significantly differing heights to comfortably, conveniently and safely use a table game with a table surface of a fixed height.

BRIEF SUMMARY OF THE INVENTION

Briefly stated, in a first aspect the invention is a combination of a table game paddle and a glove. The combination comprises a paddle, including a handle, the handle having an opening, and a glove. The glove includes a palm section and a strap having a first end and a second end. The first end of the strap is fixedly attached to the glove. The second end includes a first portion of a connector. A second portion of the connector is fixedly attached to the glove. The strap is sized and shaped to pass through the handle opening. The first portion of the connector is connectable to the second portion of the connector to releasably secure the paddle to the glove.

In a second aspect, the invention is a combination of a table game paddle and a glove. The combination comprises a paddle, including a handle. The handle has a first portion of a first connector fixedly attached thereto. The combination further comprises a glove. The glove includes a first portion of a second connector fixedly attached thereto. A strap is provided. The strap has a first end, a second portion of the first connector being fixedly attached to the first end, and the second portion being releasably attachable to the first portion of the first connector to releasably attach the first end of the strap to the paddle. The strap also has a second end, a second portion of the second connector being fixedly attached to the second end, the second portion being releasably attachable to the first portion of the second connector to releasably attach the strap to the glove.

In a third aspect, the invention is a table game paddle. The paddle comprises a wrist strap fixedly attached to the paddle.

In a fourth aspect, the invention is a visual barrier assembly for use with a game table having a first end and a second end and having a playing surface. The assembly comprises at least one support arm coupled to the game table and a visual barrier having first and second ends and being releasably attachable to the at least one support arm. The visual barrier is positionable on the support arm to obscure a user's view of at least a portion of the playing surface.

In a fifth aspect, the invention is a combination of an elevated platform and a game table having a support structure. The combination comprises a game table and an elevated platform including at least one support arm releasably connectable to the support structure in a play position and further connectable to the support structure in a storage position.

In a sixth aspect, the invention is a combination of an elevated platform and a game table having a support structure. The combination comprises a game table and an elevated platform coupled to the game table for translation relative to the support structure between a play position and a storage position.

In yet a seventh aspect, the invention is a combination of an elevated platform and a game table. The combination comprises a game table, having a supporting structure and an elevated platform, hingedly coupled to the supporting structure to allow the platform to be moved between a play position and a stored position.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
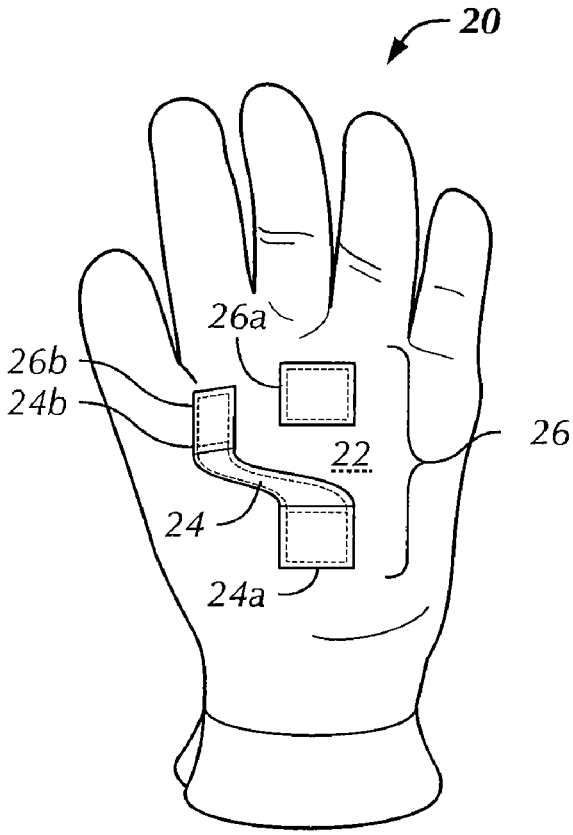
FIG. 1 is a plan view of a palm of a glove having a strap, the glove being attachable to a table hockey paddle in accordance with a first preferred embodiment of the present invention.
Figure 2:
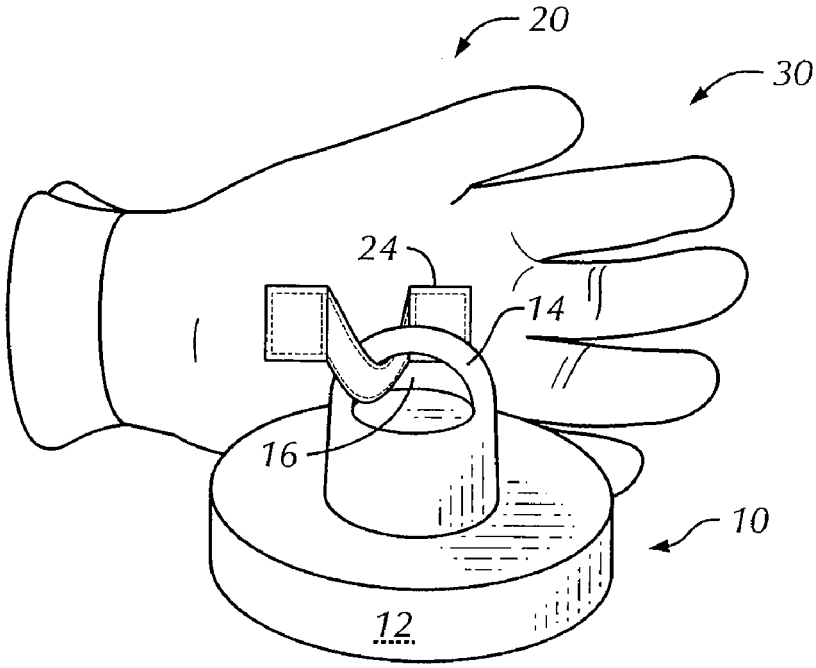
FIG. 2 is a perspective view of the glove of FIG. 1 attached to a table hockey paddle in accordance with the first preferred embodiment of the present invention.

Referring to the drawings, wherein like reference numerals are used to designate the same components throughout the several figures, there is shown in FIGS. 1-2, in accordance with a first preferred embodiment of the present invention, a combination 30 of a glove 20 and a paddle 10 for use with a table game such as table hockey or air hockey. The combination 30 comprises the paddle 10, having a base 12 and a handle 14. The handle 14 has an opening 16. The artisan would recognize that the configurations and proportions of the handle 14 and opening 16 are not limited to the configurations shown. The combination 30 further comprises the glove 20 having a palm section 22. A strap 24 having a first end 24*a* and a second end 24*b* is fixedly attached to the glove 20 at the first end 24*a*. A first portion 26*a* of a connector 26 is attached to the palm section 22, while a second portion 26*b* of the connector 26 is attached to the second end 24*b* of the strap 24. In the embodiment illustrated in FIG. 1, the connector 26 is formed by the combination of a hook and loop fastener (such as that sold under the trademark VELCRO®). Alternatively, the connector could be formed from various other known connectors, for example, male and female snaps or a button and a button hole.

The glove 20 is preferably fabricated from conventional materials well known in the art of sports gloves. The glove 20 may be padded. From this disclosure the artisan would recognize that the glove 20 could be colored in a manner to correspond to athletic teams or to incorporate athletic team or other logos.

FIG. 2 shows the combination 30 of the glove 20 and the paddle 10 wherein the paddle 10 has been releasably attached to the glove 20 with the strap 24 extending through the opening 16. A player connects the paddle 10 to the glove 20 with the strap 24 using connector 26. The player then inserts his or her hand into the glove 20 and is ready for play. During play the glove 20 serves to protect the player's hand from injury from contact with a puck used in the table game. The strap 24 prevents the paddle 10 from slipping from the player's hand and creating a projectile hazard.

Figure 3:
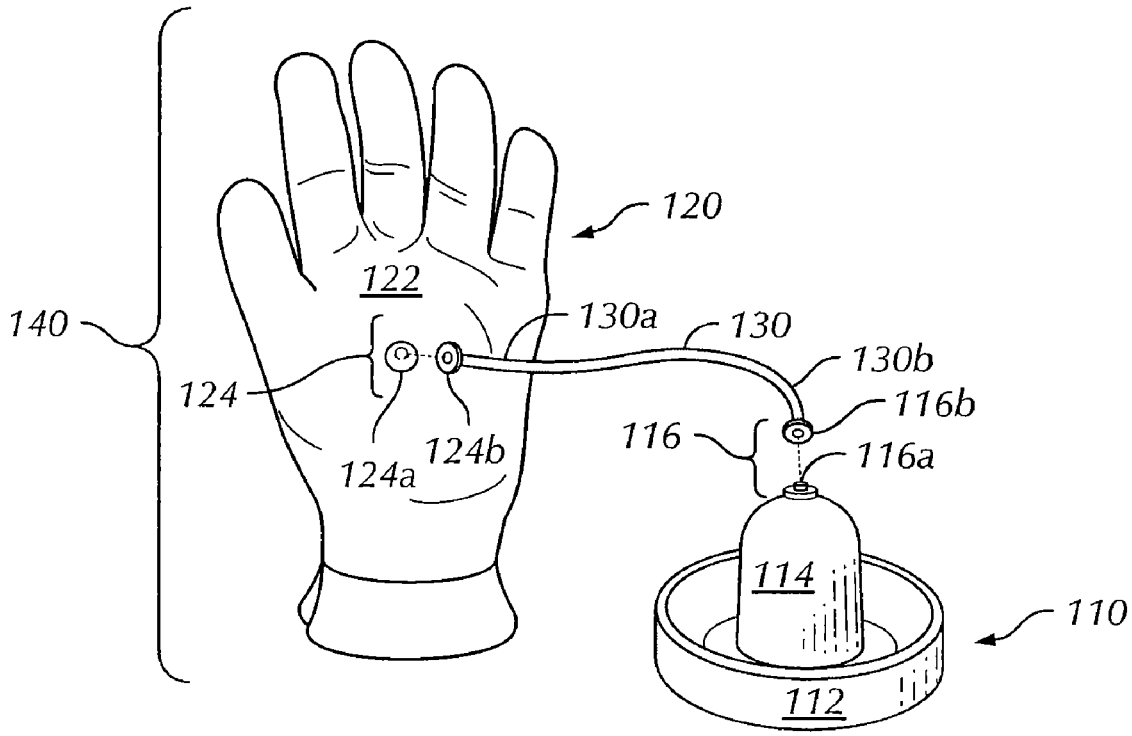
FIG. 3 is a plan view of a palm of a glove, a table hockey paddle and a strap connectable with both the glove and the table hockey paddle in accordance with a second preferred embodiment of the present invention.

A second glove and paddle combination 140 in accordance with a second preferred embodiment of the invention is shown in FIG. 3 to comprise a glove 120, a strap 130 and a table hockey paddle 110. A palm area 122 of the second glove 120 is provided with a first portion 124*a* of a first snap button assembly 124. A first end 130*a* of the second strap 130 includes a second portion 124*b* of the first snap button assembly 124.

The second paddle 110 includes a base 112 and a handle 114. A first portion 116*a* of a second connector 116 is affixed to the handle 114. A second end 130*b* of the second strap 130 has a second portion 116*b* of the second connector 116. From this disclosure, a person of ordinary skill in the art would recognize that the second strap 130 could be permanently affixed to the second glove 120, or the second paddle 110 or both. The artisan would further recognize that other types of connectors (for example, buttons and button holes) could be substituted for the snaps illustrated.

In use, a player connects the second strap 130 to both the second glove 120 and the second paddle 110 using the first and second connectors 124 and 116. The player then inserts his or her hand into the second glove 120 and is ready for play. During play the second glove 120 serves to protect the player's hand from injury resulting from contact with the puck used in the table game. The second strap 130 prevents the second paddle 110 from slipping from the player's hand and creating a projectile hazard.

Figure 4:
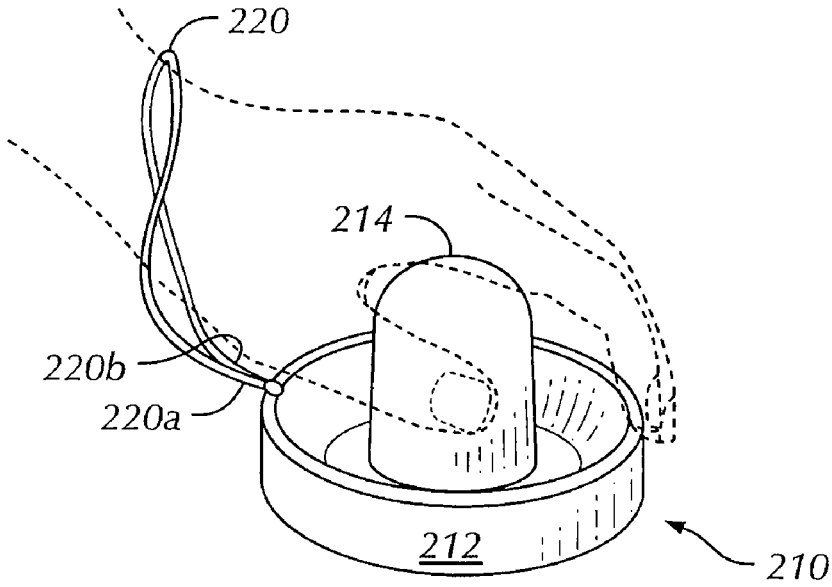
FIG. 4 is a side perspective view of a table hockey paddle with a wrist strap in accordance with a third preferred embodiment of the present invention.

A third paddle 210 having a wrist strap 220 affixed thereto in accordance with a third preferred embodiment of the invention is shown in FIG. 4. The third table hockey paddle 210 has a base 212 and a handle 214. The wrist strap 220 has a first end 220*a* and a second end 220*b*, both first and second ends 220*a*, 220*b* being fixedly connected to the third paddle 210. The wrist strap 220 has a length sufficient to allow a user to comfortably secure the wrist strap 220 about his or her wrist while grasping the third paddle 210 in a position suitable for engaging in play. In use, the player secures the third paddle 210 to his or her wrist with the wrist strap 220 and is ready for play. During play the wrist strap 220 reduces the potential for the third embodiment paddle 210 slipping from the player's hand and creating a projectile hazard.

The artisan will recognize that when a paddle slips and is lost from a player's grasp, it not only creates a projectile hazard, but also disrupts play while the paddle is being retrieved, and further creates a disadvantage to a player who loses his or her paddle, allowing the opposing player to more easily score. The first, second and third embodiments each help avoid these negative consequences of a lost paddle.

Figure 5:
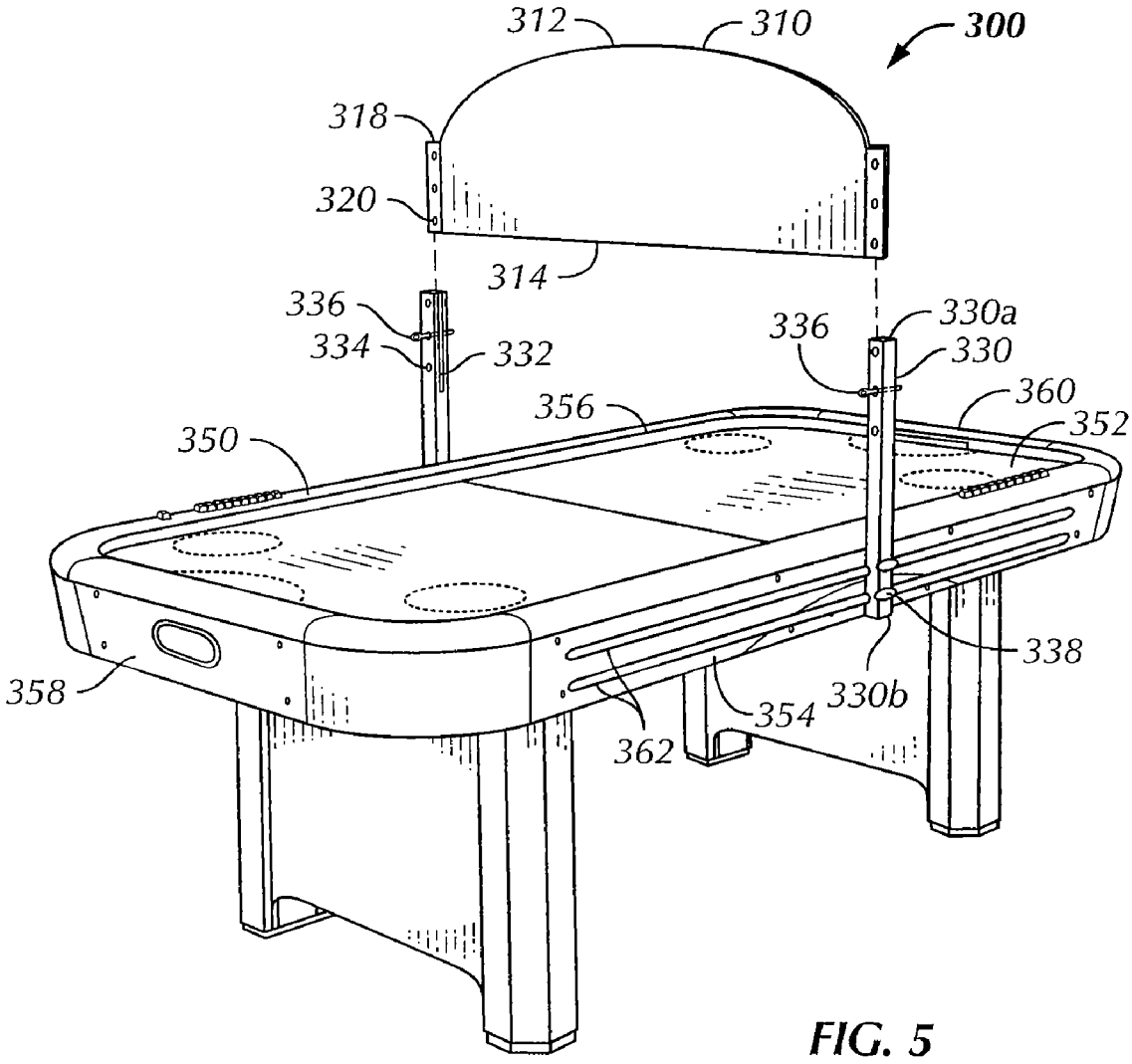
FIG. 5 is a perspective view of a table hockey game table with a visual barrier in accordance with a fourth preferred embodiment of the present invention.

Referring now to FIG. 5, a fourth preferred embodiment of the present invention and first embodiment of a visual barrier assembly 300 for use with a table game such as air hockey is illustrated. The first embodiment barrier assembly 300 comprises at least one, and preferably two, support arms 330 coupled to a game table 350. The game table 350 has a first end 358 and a second end 360. The support arms 330 have a first end 330*a* and a second end 330*b*. Preferably, the support arms 330 are mounted in a vertical orientation with respect to a horizontal playing surface 352 of the table 350. The support arms 330 are preferably mounted on opposing first and second lateral sides 354 and 356 of the table 350, at approximately a midpoint of the playing surface 352, by support connectors 338. In a preferred embodiment, each support arm 330 is mounted for translation relative to the table 350 within one or more longitudinal tracks 362, such that the support arms 330 may be moved within the longitudinal tracks 362 between the first and second ends 358 and 360.

A visual barrier panel 310 is releasably attachable to the support arms 330. The visual barrier 310 has a top edge 312, a bottom edge 314, a first end 316 and a second opposing end 318. In the preferred embodiment illustrated in FIG. 5, the support arms 330 each have a vertical track 332 extending longitudinally along an interior portion of the support arms 330. The visual barrier 310 is sized and shaped to be received for vertical translation within the vertical tracks 332. At least one barrier height adjustment hole 334 is positioned along the length of each support arm 330, and releaseably receives a pin 336. The visual barrier 310 has at least one, and preferably a plurality of attachment holes 320 preferably disposed on opposing ends 316 and 318. The visual barrier 310 is capable of being releaseably connected to the support arms 330 by positioning the visual barrier ends 316, 318 within the vertical tracks 332, and aligning the barrier height adjustment hole 334 with the attachment hole 320 corresponding to a desired height of the visual barrier 310, followed by inserting the pin 336 within the aligned holes.

In use, the visual barrier 310 is installed and the vertical height is adjusted to players' preferences by positioning the desired attachment hole 320 in register with the barrier height adjustment hole 334, and by installing pin 336 to releasably connect the visual barrier 310 to the support arms 330. The visual barrier 310 functions to obscure at least a portion of each player's view of the playing surface 352, particularly the portion of the playing surface 352 near the opposing player, thus decreasing each player's reaction time to a shot made by his or her opponent. The difficulty, and also the entertainment value, of the table game is thus increased. Additionally, the position of visual barrier 310 along the length of the table 350 may be adjusted by moving the support arms 330 within the tracks 362. Such longitudinal position adjustment allows the play to be handicapped in favor of the player at the end of the table 350 from which the visual barrier 310 is moved, by increasing the amount of the playing surface 352 seen by the favored player (and increasing his or her reaction time) and biases play against the opposing player, whose view of the playing surface 352 is further obscured and whose reaction time is consequently further reduced.

Figure 6:
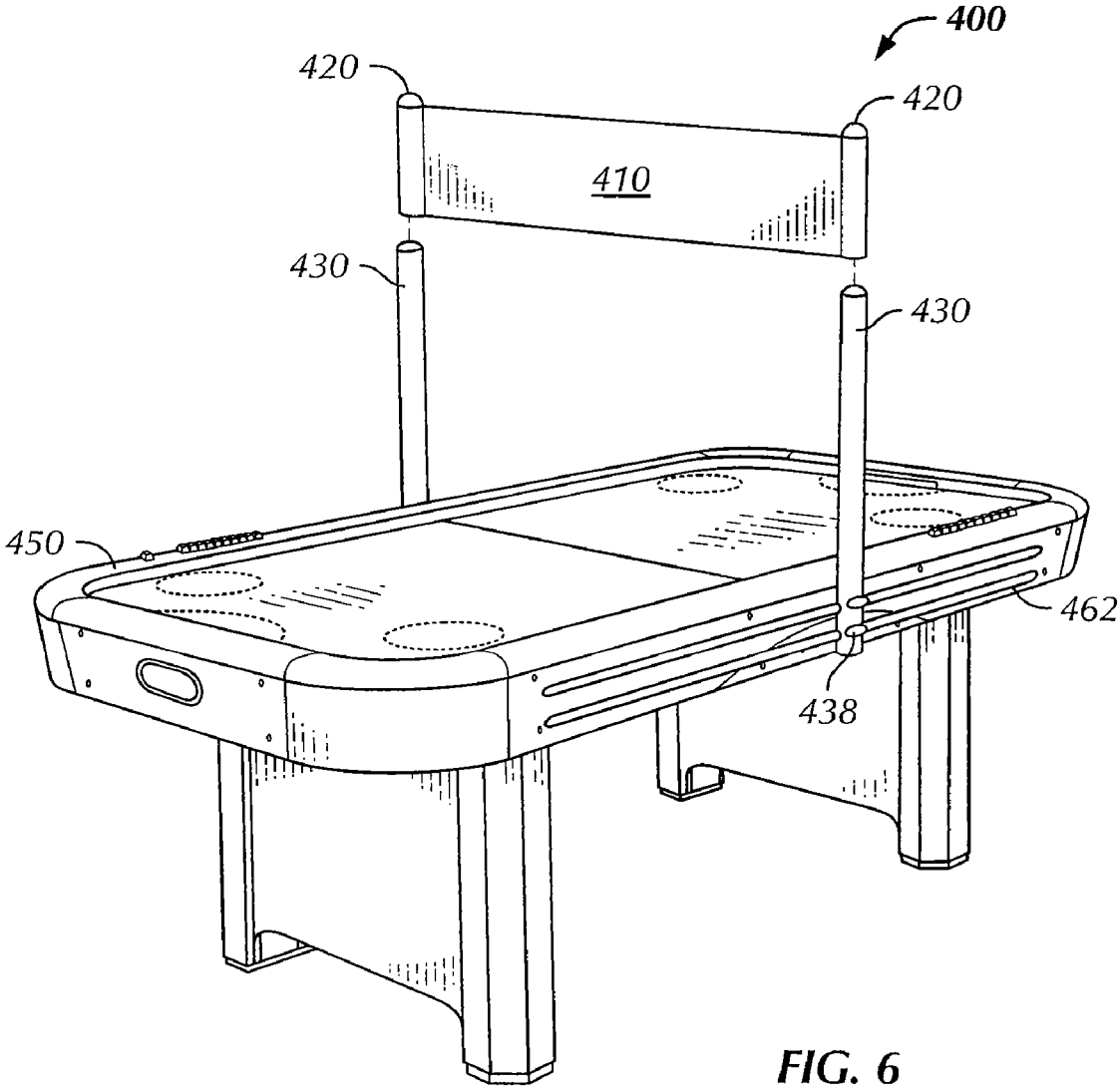
FIG. 6 is a perspective view of a table hockey game table with a visual barrier in accordance with a fifth preferred embodiment of the present invention.

Referring now to FIG. 6, a fifth preferred embodiment of the present invention and second embodiment of a visual barrier assembly 400 is illustrated. The second embodiment barrier assembly 400 differs fundamentally from the first embodiment barrier assembly 300 in the manner in which a second embodiment visual barrier 410 attaches to second embodiment support arms 430. As with the first embodiment visual barrier assembly 300, at least one and preferably two support arms 430 are provided. The second embodiment support arms 430 are preferably mounted to a game table 450 in longitudinally extending tracks 462 by connectors 438, allowing the support arms 430 to be positioned at various locations along the length of the table 450 in a manner similar to that discussed above relative to the first embodiment barrier assembly 300. In contrast to the first embodiment visual barrier 310, the second embodiment visual barrier 410 has sleeves 420 disposed at opposing ends. The sleeves 420 slide over the second embodiment support arms 430, connecting the second embodiment visual barrier 410 to the second embodiment support arms 430. The vertical position of the second embodiment visual barrier 410 may be easily adjusted by simply sliding the sleeves 420 up or down relative to the second embodiment support arms 430. The second embodiment support arms 430 thus do not require height position adjustment holes 334 or pins 336 or a barrier track 332, as seen in the first embodiment of the visual barrier assembly 300. Otherwise, the second embodiment visual barrier 410 functions similarly to the first embodiment visual barrier 310.

The first embodiment of the visual barrier 310 and the first and second embodiments of the support arms 330 and 430 are preferably fabricated from wood, metal or polymeric materials or a combination thereof. The second embodiment of the visual barrier 410 is preferably fabricated from a durable, resilient and flexible cloth material, for example the material sold under the trademark CORDURA®.

Figure 7:
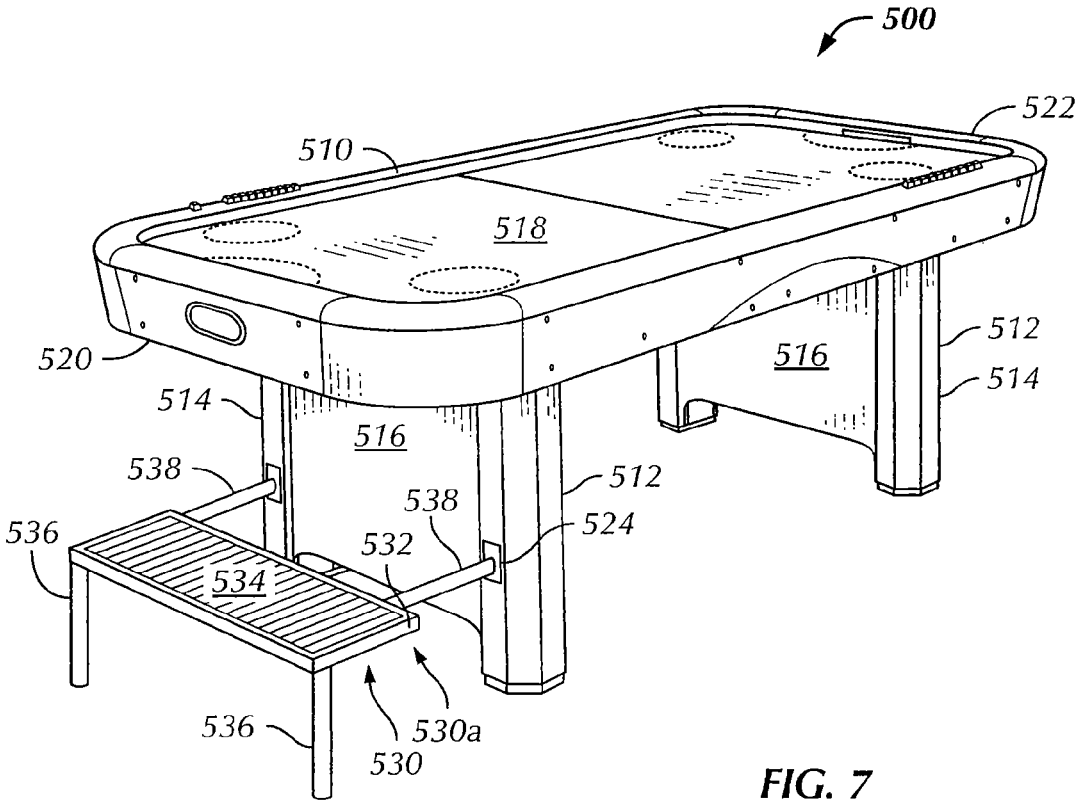
FIG. 7 is a perspective view of a player platform for use with table games in accordance with a sixth preferred embodiment of the present invention.
Figure 8:
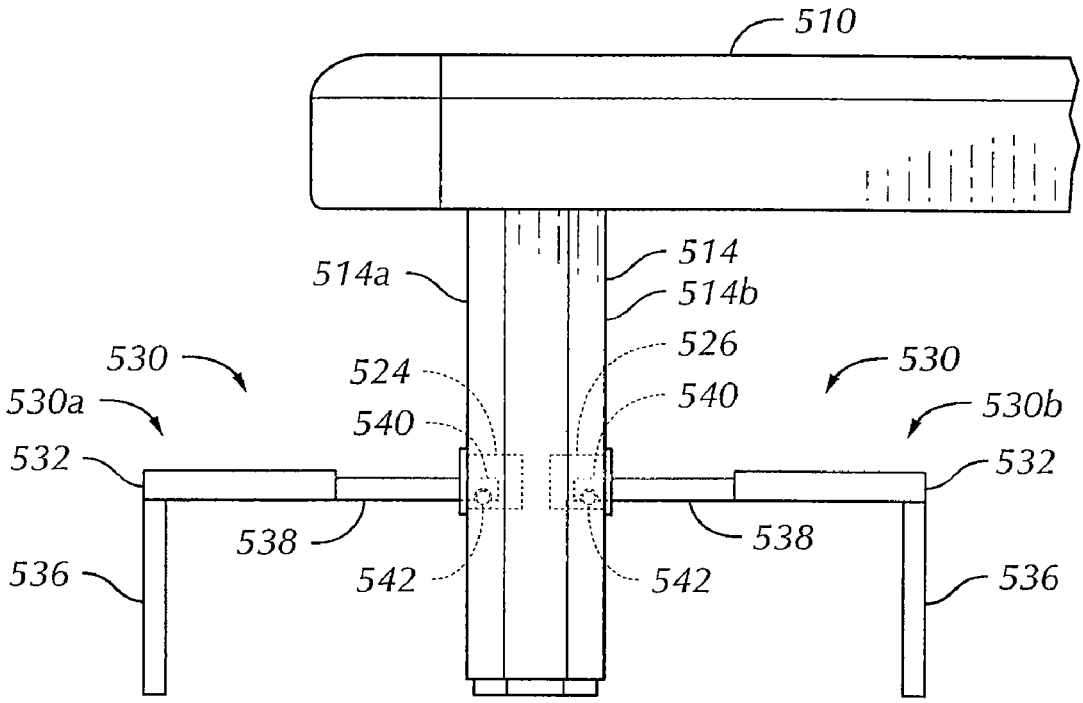
FIG. 8 is side elevational view of the player platform of FIG. 7, shown in both a play position and in a storage position.

A sixth preferred embodiment of the present invention and first embodiment of a combination 500 of an elevated platform and a game table is illustrated in FIGS. 7 and 8. The combination 500 comprises a game table 510 and a first embodiment of a stool 530. The game table 510 has a playing surface 518. The game table 510 is supported at first and second ends 520 and 522 by supports 512 including legs 514 connected by a panel 516. The first embodiment stool 530 releasably attaches to the legs 514 on an exterior side of the legs 514*a* in a play configuration 530*a*. The first embodiment stool 530 also releasably attaches to the legs 514 on an interior side of the legs 514*b* in a storage configuration 530*b*. The first embodiment stool 530 has a platform 532 supported by support legs 536 along a first edge and by support arms 538 along a second edge. The height of the platform 532 is preferably in the range of 6 to 10 inches, allowing persons of heights in the range of approximately 42 inches to approximately 54 inches to be boosted to a position where they enjoy a suitable view of the playing surface 518 and further are boosted to a position where they may comfortably reach the playing surface 518.

In the play configuration 530*a*, the support arms 538 are releaseably connected to a first pair of receptacles 524 accessible along the exterior sides 514*a* of the legs 514 to secure the stool 530 to the legs 514. Similarly, in the storage configuration 530*b*, the support arms 538 are releaseably connected to a second pair of receptacles 526 accessible from the interior sides 514*b* of the legs 514. Each support arm 538 terminates in a hook portion 540 which releaseably engages a mating pin 542 within receptacles 524, 526.

The first embodiment stool 530 may be fabricated from any number of conventional furniture materials, including wood, steel or polymeric materials or a combination thereof. The platform 532 preferably includes a non-skid surface 534 fabricated from a rubber, rubber-like or other non-slip material to improve traction of a player standing on the first embodiment stool 530.

In use, if players of significantly different heights wish to engage in the table game, the shorter player will place the stool 530 in the play configuration 530*a* and stand on the stool 530 to reach a comfortable playing position relative to the table surface 518. If two players, neither of whom requires use of the stool 530, wish to engage in the table game, the stool 530 will be returned to the storage position 530*b*. Note that the stool 530 is rigidly and securely affixed to the table legs 510, providing a stable, secure and safe platform to elevate the smaller player. Note further that the stool 530 may be very readily and conveniently stored in and retrieved from storage position 530*b*.

Figure 9:
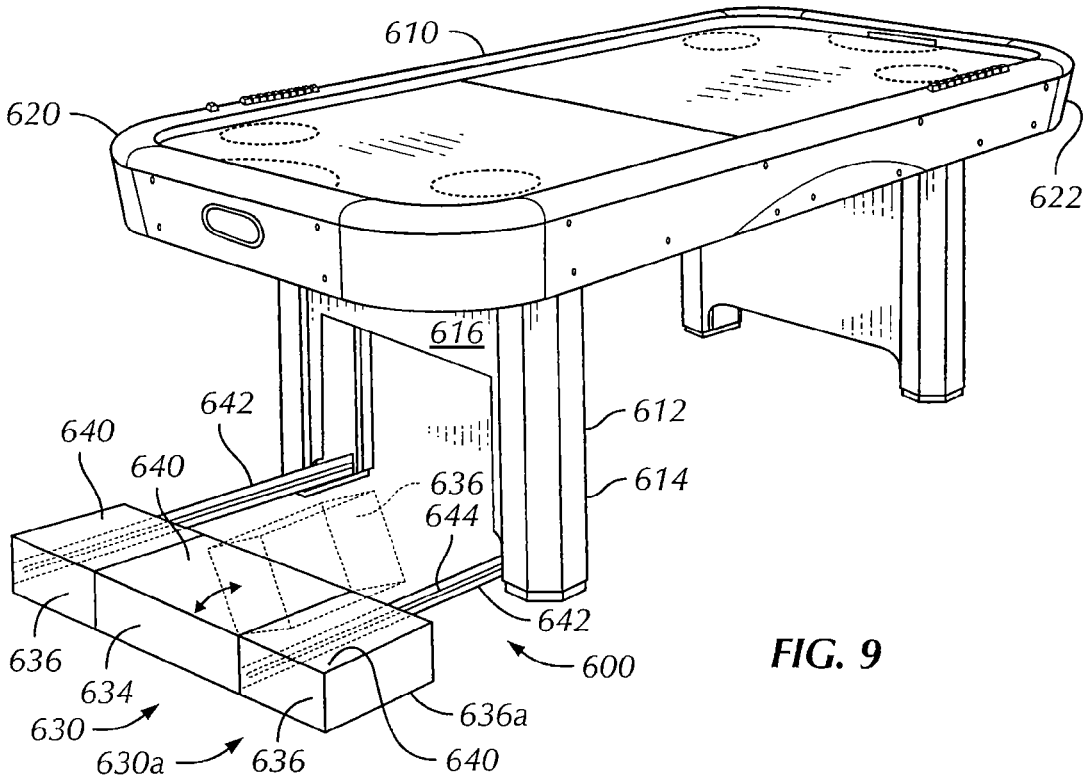
FIG. 9 is perspective view of a player platform for use with table games in accordance with a seventh preferred embodiment of the present invention.
Figure 10:
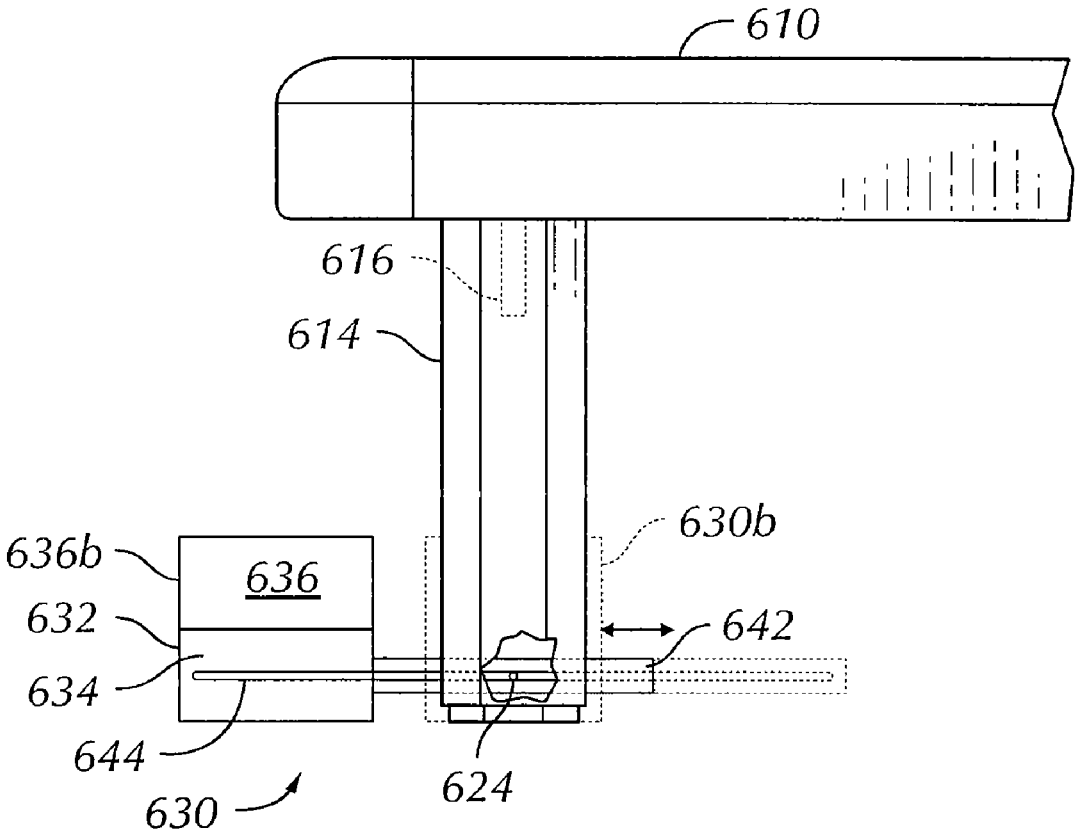
FIG. 10 is a side elevational view of the player platform of FIG. 9, illustrating translation of the platform relative to table supporting structure.

A seventh preferred embodiment of the present invention and second embodiment of a combination 600 of an elevated platform and a game table is illustrated in FIGS. 9 and 10. The combination 600 comprises a game table 610 and a second embodiment of a stool 630. The game table 610 is supported at first and second ends 620 and 622 by supports 612 including legs 614 connected by a panel 616. The second embodiment stool 630 attaches to the legs 614 with support arms 642 for translation between a play configuration 630*a* and a storage configuration 630*b*.

In the presently preferred embodiment illustrated, the second embodiment stool 630 includes a platform 632 comprising a pair of platform extensions 636 hingedly attached to a central platform 634. The platform extensions 636 pivot between an extended play position 636*a* and a stored position 636*b*. With both platform extensions 636 in the stored position 636*b*, the second embodiment stool 630 is sufficiently compact to slide into the stool stored position 630*b* between table legs 614. With both platform extensions 636 in the extended position 636*a*, the second embodiment stool 630 is sufficiently wide to allow a player to position himself or herself at any position along the width of the game table 610. The platform 632 preferably includes a non-skid surface 640 similar to that discussed above relative to the first embodiment stool 530.

The support arms 642 and sides of the central platform 634 of the second embodiment stool 630 preferably include tracks 644 in which support arm connectors 624 travel when the second embodiment stool 630 is translating between the play configuration 630*a* and the storage configuration 630*b*. The support arm connectors 624 are fixedly connected to the table legs 614.

The second embodiment stool 630 may be fabricated from any number of conventional furniture materials, including wood, steel or polymeric materials or a combination thereof. The non-skid surface 640 is preferably a rubber, rubber-like or other non-slip material to improve traction of a player standing on the platform 632.

In use, a short player requiring use of the second embodiment stool 630 will place the stool 630 in the play configuration 630*a*, with the platform extensions 636 in the play position 636*a*, thus creating a platform to elevate the shorter player to a satisfactory position. If two players neither of whom require use of the second embodiment stool 630 wish to engage in the table game, the second embodiment stool 630 will be returned to the stored position 630*b*, with the platform extensions 636 in the stored position 636*b*. Thus, the second embodiment stool 630 provides a stable and secure platform which may be very conveniently moved between stored and operative positions.

Figure 11:
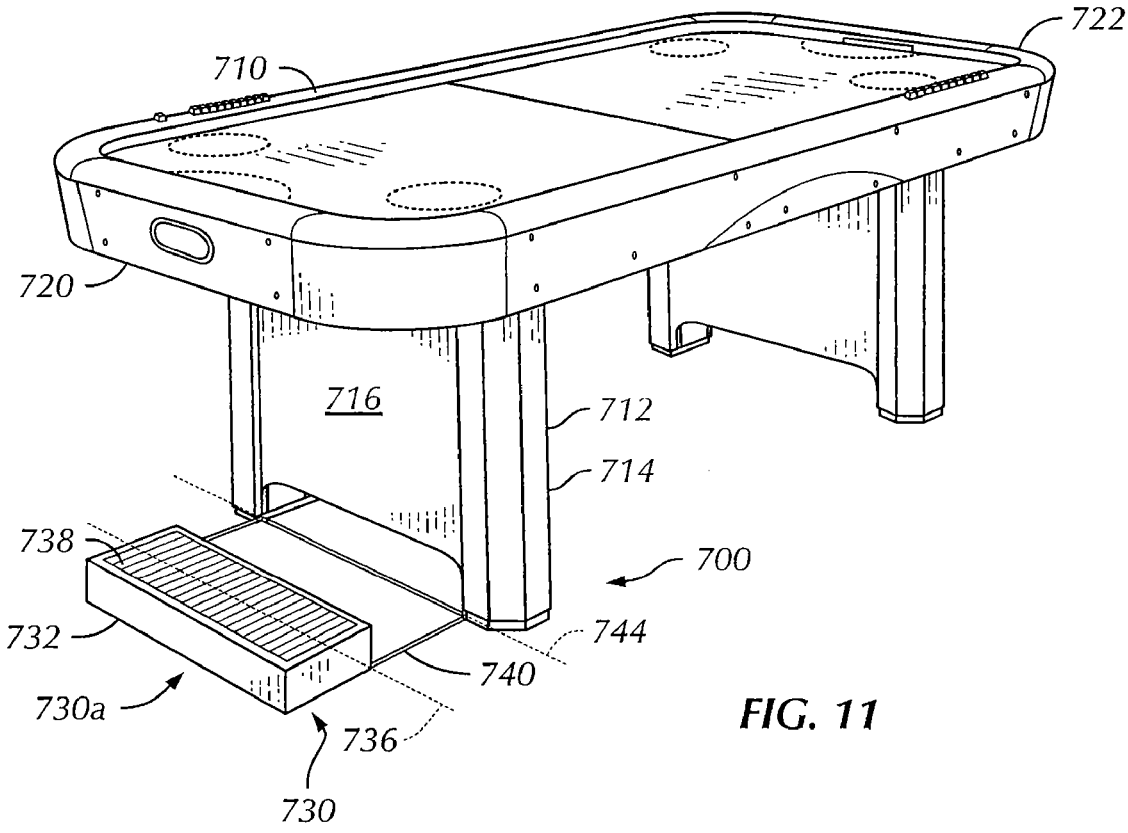
FIG. 11 is a perspective view of a player platform for use with table games in accordance with an eighth preferred embodiment of the present invention.
Figure 12:
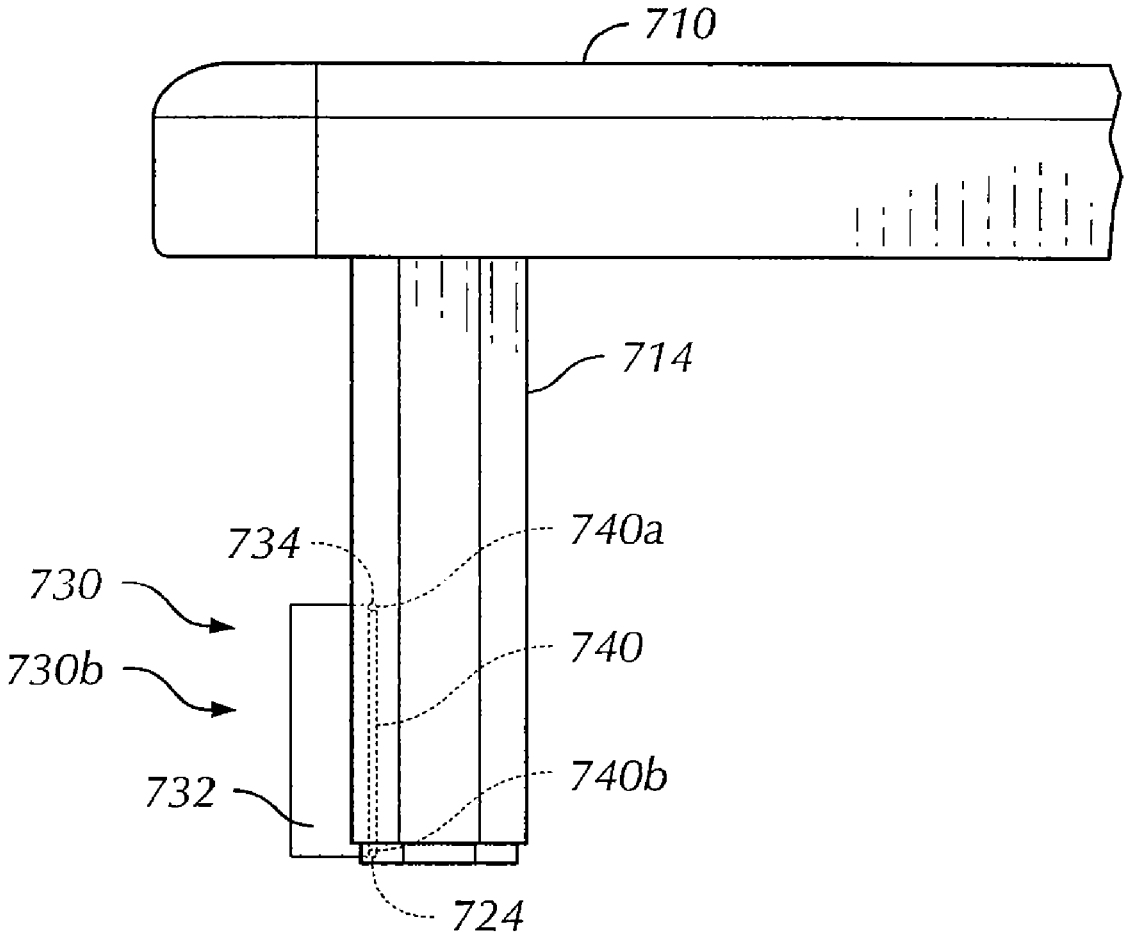
FIG. 12 is a side elevational view of a portion of the player platform of FIG. 11.

An eighth preferred embodiment of the present invention and third embodiment of a combination 700 of an elevated platform and a game table is illustrated in FIGS. 11 and 12. The combination 700 comprises a game table 710 and a third embodiment of a stool 730. The game table 710 is supported at first and second ends 720 and 722 by supports 712 including legs 714 connected by a panel 716. The third embodiment stool 730 hingedly attaches to the legs 714 with a support member 740 for pivotal movement between a play configuration 730*a* and a storage configuration 730*b*.

In the presently preferred embodiment illustrated, the third embodiment stool 730 includes a platform 732 hingedly attached to the support member 740 at a first end 740*a* of the support member 740 by a platform hinge connection 734. The support member 740 has a second end 740*b* hingedly attached to the table legs 714 by a support member hinge connection 724. The platform hinge connection 734 pivots about a platform hinge pivot axis 736, while the support member hinge connection pivots about a support member hinge pivot axis 744. The platform 732 preferably includes a non-skid surface 738 similar to that discussed above relative to the first and second embodiment stools 530 and 630.

The third embodiment stool 730 may be fabricated from any number of conventional furniture materials, including wood, steel or polymeric materials or a combination thereof. The non-skid surface 738 is preferably fabricated from a rubber, rubber-like or other non-slip material.

In use, a short player will place the third embodiment stool 730 in the play configuration 730*a*, thus creating a platform to elevate the short player to a satisfactory position. If use of the stool 730 is not required, the third embodiment stool 730 will be pivoted to the stored position 730*b*. The third embodiment combination 700 may be provided with a latch (not illustrated) to retain the third embodiment stool in the storage position 730*b*.

From the foregoing it can be seen that the present invention comprises various improvements to table games, such as table hockey. The various improvements address the unmet needs of: a device which would serve to protect the hands of players engaged in table hockey; a device which would reduce the potential of a table hockey paddle inadvertently slipping from a player's grasp while engaged in play; a device which would increase the challenge of the game by requiring faster responses on the part of the players by decreasing each player's view of the table surface and a device which allows players of diminutive stature to comfortably, conveniently and safely use a table game with a table surface of a fixed height. It will be appreciated by those of ordinary skill in the art that modifications may be made to the above described embodiment without departing from the scope and spirit of the present invention.

I claim:

1. A combination of an elevated platform and a game table, the combination comprising:

a game table, having a supporting structure;

an elevated platform, hingedly coupled to the supporting structure to allow the platform to be moved between a play position and a stored position;

a paddle, including a handle, the handle having an opening; and a glove, the glove including:

a palm section; and a strap having a first end and a second end, the first end being fixedly attached to the glove and the second end including a first portion of a connector;

a second portion of the connector fixedly attached to the glove;

wherein the strap is sized and shaped to pass through the handle opening and the first portion of the connector is connectable to the second portion of the connector to releasably secure the paddle to the glove.

2. The combination of claim 1 wherein the first end is fixedly attached to the palm section.

3. The combination of claim 1 wherein the connector is formed by the combination of a hook portion and a loop portion of a hook and loop fastener.

4. The combination of claim 1 wherein the connector is a combination of a button and a button hole.

5. The combination of claim 1 wherein the connector is a combination of a male portion and a female portion of a snap.

6. A combination of an elevated platform and a game table having a support structure, the combination comprising:

a game table;

an elevated platform including at least one support arm releasably connectable to the support structure in a play position and further connectable to the support structure in a storage position;

a paddle, including a handle, the handle having a first portion of a first connector fixedly attached thereto;

a glove, the glove including a first portion of a second connector fixedly attached thereto; and a strap having:

a first end, a second portion of the first connector being fixedly attached to the first end, the second portion being releasably attachable to the first portion of the first connector to releasably attach the first end of the strap to the paddle, and a second end, a second portion of the second connector being fixedly attached to the second end, the second portion being releasably attachable to the first portion of the second connector to releasably attach the strap to the glove.

7. The combination of claim 6 wherein the first and second connectors are snaps.

* * * * *